US012157508B2

(12) United States Patent
Rosenberger

(10) Patent No.: US 12,157,508 B2
(45) Date of Patent: Dec. 3, 2024

(54) METHOD FOR MEASURING WEAR OF A RAIL AND EVALUATION SYSTEM

(71) Applicant: Frauscher Sensortechnik GmbH, St. Marienkirchen (AT)

(72) Inventor: Martin Rosenberger, Eggerding (AT)

(73) Assignee: Frauscher Sensortechnik GmbH, St. Marienkirchen (AT)

( * ) Notice: Subject to any disclaimer, the term of this patent is extended or adjusted under 35 U.S.C. 154(b) by 369 days.

(21) Appl. No.: 17/628,194

(22) PCT Filed: Jul. 15, 2020

(86) PCT No.: PCT/EP2020/069989
§ 371 (c)(1),
(2) Date: Jan. 18, 2022

(87) PCT Pub. No.: WO2021/013651
PCT Pub. Date: Jan. 28, 2021

(65) Prior Publication Data

US 2022/0258780 A1 Aug. 18, 2022

(30) Foreign Application Priority Data

Jul. 19, 2019 (EP) ..... 19187283

(51) Int. Cl.
*B61L 23/04* (2006.01)

(52) U.S. Cl.
CPC ..... *B61L 23/045* (2013.01)

(58) Field of Classification Search
CPC ..... B61L 23/045; B61L 27/53; B61L 1/08
See application file for complete search history.

(56) References Cited

U.S. PATENT DOCUMENTS

| | | | |
|---|---|---|---|
| 5,381,700 | A | 1/1995 | Grosskopf |
| 5,508,698 | A | 4/1996 | Hoekman |
| 2004/0261533 | A1 | 12/2004 | Davenport et al. |

FOREIGN PATENT DOCUMENTS

| | | | |
|---|---|---|---|
| CN | 104024070 | A | 9/2014 |
| CN | 104260755 | A | 1/2015 |

(Continued)

OTHER PUBLICATIONS

Extended European Search Report from European Patent Application No. 19187283.7, dated Jan. 23, 2020, 5 pages.

(Continued)

*Primary Examiner* — Eric S. McCall
*Assistant Examiner* — Timothy P Graves
(74) *Attorney, Agent, or Firm* — Morgan, Lewis & Bockius LLP

(57) ABSTRACT

A method for measuring wear of a rail (20) comprises detecting a first set of wheel signals (SW1) by a wheel sensor (21) mounted to the rail (20), determining a first average wheel signal (AV1) of the first set of wheel signals (SW1), detecting at least one second set of wheel signals (SW2) by the wheel sensor (21), where the second set of wheel signals (SW2) is detected after detecting the first set of wheel signals (SW1), determining a second average wheel signal (AV2) of the second set of wheel signals (SW2), and determining a difference signal (DIF) given by the difference between the second average wheel signal (AV2) and the first average wheel signal (AV1), wherein a wheel signal is detected when a wheel (22) of a rail vehicle passes the wheel sensor (21). Furthermore, an evaluation system (23) for measuring wear of a rail (20) is provided.

14 Claims, 5 Drawing Sheets

(56) References Cited

FOREIGN PATENT DOCUMENTS

Figure 1:
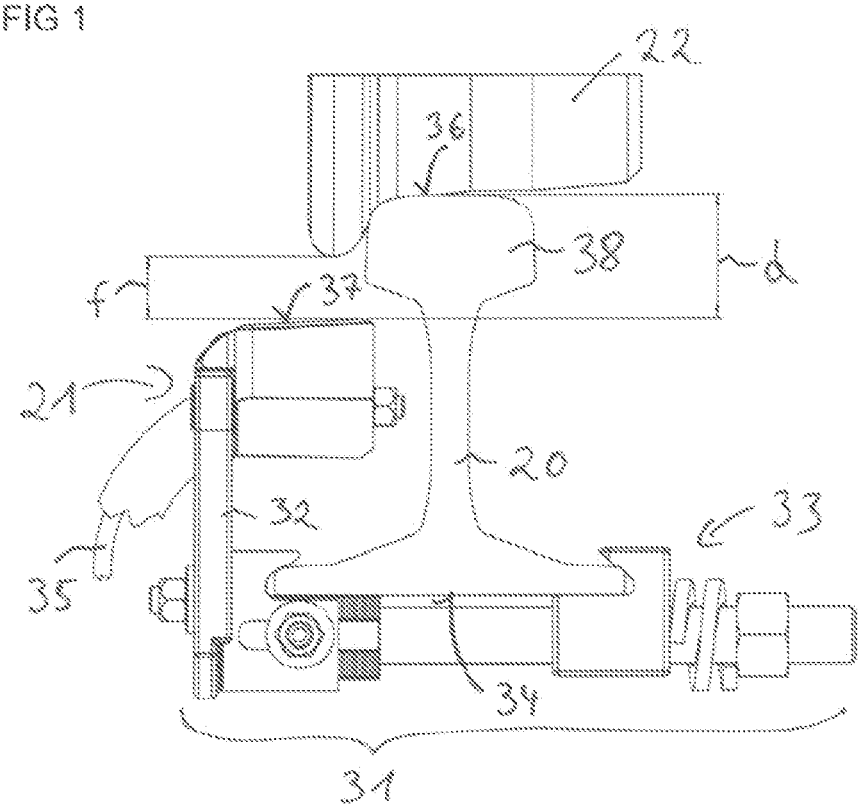

| | | | | |
|---|---|---|---|---|
| CN | 106537155 | A | 3/2017 | |
| CN | 106660567 | A | 5/2017 | |
| CN | 107406090 | A | 11/2017 | |
| CN | 107646004 | A | 1/2018 | |
| CN | 108674442 | A | 10/2018 | |
| DE | 19913127 | A1 | 9/2000 | |
| WO | WO2013092956 | A2 | 6/2013 | |
| WO | WO-2017082730 | A1 * | 5/2017 | ..... B61D 15/08 |
| WO | WO 2018/108428 | | 6/2018 | |

OTHER PUBLICATIONS

Chinese Office Action & Search Report from Application No. 2020800517543, dated Feb. 2, 2023, 15 pages including translation.

* cited by examiner

METHOD FOR MEASURING WEAR OF A RAIL AND EVALUATION SYSTEM

A method for measuring wear of a rail and an evaluation system for measuring wear of a rail are provided.

The passing of rail vehicles leads to wear of rails. Due to the contact between the wheels of the rail vehicles and the rail, material of the rail is removed. Furthermore, tear or cracks can occur.

Wheel sensors for detecting rail vehicles are typically mounted to the rails in such a way that they do not touch the wheels of passing rail vehicles. This means, the wheel sensors operate contactless.

With time the shape of rails can change due to wear and tear of the rails. The wear of rails depends on many factors as for example the number, the length, the weight, the speed, the acceleration and the deceleration of passing rail vehicles. The wear of a rail can lead to a reduced distance between the wheel sensor and the wheels of passing rail vehicles. In order to avoid damage of the wheel sensor it is necessary to measure the wear of the rail. If the distance between the wheels of a passing rail vehicle and the wheel sensor drops below a threshold value it is necessary to lower the position of the wheel sensor in order to avoid damage of the wheel sensor.

The state of rails can be determined by manual or automatic measurements using special measuring gauges or instruments. These measurements have to be carried out at the location of the rail. Therefore, the measurements can be time and cost consuming. Nevertheless, it is necessary to determine the state of rails in regular intervals.

It is an objective to provide a method for measuring wear of a rail with an improved efficiency. It is further an objective to provide an evaluation system for measuring wear of a rail with an improved efficiency.

These objectives are achieved with the independent claims. Further embodiments are the subject of dependent claims.

According to at least one embodiment of the method for measuring wear of a rail, the method comprises the step of detecting a first set of wheel signals by a wheel sensor mounted to the rail. The first set of wheel signals comprises a plurality of wheel signals. The wheel signals can be output signals of the wheel sensor. The wheel sensor is configured to detect the presence of a wheel of a rail vehicle in the vicinity of the wheel sensor. The first set of wheel signals can be a fixed number of wheel signals. The wheel signals of the first set of wheel signals are detected one after another. The wheel signals of the first set of wheel signals can be detected directly one after another. Preferably, the first set of wheel signals is detected immediately after setting up and calibrating the wheel sensor.

A wheel signal is detected when a wheel of a rail vehicle passes the wheel sensor. This means, each wheel signal relates to the presence of a wheel of a rail vehicle in the vicinity of the wheel sensor. The wheel sensor is a contactless sensor which is not in direct contact with the wheels of the rail vehicle during measurement. Therefore, the wheel sensor is configured to detect if a wheel of a rail vehicle is present in the vicinity of the wheel sensor. The wheel sensor can further be configured to detect if a wheel of a rail vehicle passes the position of the wheel sensor.

When a wheel of a rail vehicle passes the wheel sensor, a wheel signal is detected. For the next wheel of the same rail vehicle another wheel signal is detected. This means, each wheel signal relates to the passing of one wheel.

The wheel sensor can comprise an inductive sensor. The inductive sensor can be capable of detecting a change of a magnetic field induced by metal moving in the magnetic field. The metal moving in the magnetic field can be the wheel of a rail vehicle. For each change of the magnetic field the wheel sensor detects a wheel signal. The amplitude of a wheel signal relates to the change of the magnetic field. Therefore, the amplitudes of wheel signals relating to different wheels can differ from each other.

The method further comprises the step of determining a first average wheel signal of the first set of wheel signals. The first average wheel signal of the first set of wheel signals is determined by averaging all wheel signals of the first set of wheel signals. This means, the mean value of the wheel signals of the first set of wheel signals is determined.

The method further comprises the step of detecting at least one second set of wheel signals by the wheel sensor, where the second set of wheel signals is detected after detecting the first set of wheel signals. The second set of wheel signals comprises a plurality of wheel signals. The second set of wheel signals can be a fixed number of wheel signals. The wheel signals of the second set of wheel signals are detected one after another. The wheel signals of the second set of wheel signals can be detected directly one after another. All wheel signals of the second set of wheel signals are detected after the detection of the first set of wheel signals.

If more than one second set of wheel signals is detected, a wheel signal can be comprised by several second sets of wheel signals. This means, the second sets of wheel signals can overlap.

Alternatively, the second sets of wheel signals do not overlap and each wheel signal is comprised by only one set of wheel signals.

The method further comprises the step of determining a second average wheel signal of the second set of wheel signals. The second average wheel signal of the second set of wheel signals is determined by averaging all wheel signals of the second set of wheel signals. This means, the mean value of the wheel signals of the second set of wheel signals is determined.

The method further comprises the step of determining a difference signal given by the difference between the second average wheel signal and the first average wheel signal. If the first average wheel signal and the second average wheel signal comprise several values, respectively, for determining the difference signal for each of these values the difference is determined.

The method for measuring wear of a rail allows to determine the state of wear of a rail. The first set of wheel signals can be determined after the wheel sensor is set up and calibrated. This means, during the detection of the first set of wheel signals the rail is relatively new and shows negligible signs of wear. Therefore, the first set of wheel signals is employed as a reference value. It is required to record a plurality of wheel signals as the first set of wheel signals because wheels of different rail vehicles lead to different wheel signals. In order to outweigh the differences between different wheels passing the wheel sensor, the first average wheel signal is determined. This means, the first average wheel signal is an average wheel signal for the state of the rail where the wear is negligible.

Since the second set of wheel signals is detected after detecting the first set of wheel signals, the second set of wheel signals is detected at a time where the wear is increased in comparison to the time during which the first set of wheel signals is detected. With increasing wear of the rail the distance between the wheel sensor and the wheel of a passing rail vehicle decreases. As the amplitude of a wheel signal depends on the distance between the wheel sensor and the wheel, the wear of a rail can be determined from the wheel signals. With increasing wear of the rail the absolute value of the wheel signal is increased.

By determining the difference signal the difference between the first average wheel signal, this means a state of negligible wear of the rail, and the second average wheel signal, this means the state of increased wear of the rail, is determined. Therefore, the difference signal is a measure for the wear of the rail.

Advantageously, the method allows to determine the wear of a rail from wheel signals detected by wheel sensors. The wheel sensors are typically arranged at the rail for monitoring the traffic of rail vehicles. Thus, for the measurement of the wear of the rails no extra equipment is required. The wheel signals that are detected for monitoring the traffic of rail vehicles are also employed for determining the wear of the rail. Furthermore, no manual inspection of the rails is required. It is not necessary to travel to the location of a rail in order to determine its state of wear. Consequently, the method allows an efficient measurement of wear of a rail. Furthermore, the method enables an improved maintenance of rails as the condition of the rails can be monitored continuously.

According to at least one embodiment of the method the first set of wheel signals and the at least one second set of wheel signals comprise the same number of wheel signals. This means for determining the first average wheel signal and the second average wheel signal the same number of wheel signals is averaged, respectively. Therefore, different properties of the first set of wheel signals and the second set of wheel signals can be easily compared, as for example the root mean square deviation.

According to at least one embodiment of the method the first set of wheel signals and the at least one second set of wheel signals comprise at least ten wheel signals, respectively. It is further possible that the first set of wheel signals and the second set of wheel signals comprise at least 1000 wheel signals, respectively. It is further possible that the first set of wheel signals and the second set of wheel signals comprise at least 10,000 wheel signals, respectively. The number of wheel signals of the first set of wheel signals and of the second set of wheel signals is determined according to the type of rail and the number of different rail vehicles passing the rail. If only one type of rail vehicles passes the rail, a smaller number of wheel signals is required to acquire an average wheel signal than for the case that many different types of rail vehicles pass the rail. The number of wheel signals of the first set of wheel signals and the second set of wheel signals is chosen in such a way, that differences between different types of wheels outweigh each other.

According to at least one embodiment of the method the first average wheel signal is a reference signal for a state of no or a known wear of the rail. This means, the first set of wheel signals is detected at a time where the rail shows negligible wear. Alternatively, the first set of wheel signals is detected at a time where the rail shows a known state of wear. All wheel signals detected after the detection of the first set of wheel signals are detected at a time where the wear of the rail is increased in comparison to the time where the first set of wheel signals is detected. Therefore, the first average wheel signal is a reference signal. This means, advantageously the state of wear of a rail can be determined from wheel signals of a wheel sensor. No further equipment is required at the rail.

According to at least one embodiment of the method the difference signal relates to the state of wear of the rail. The difference signal gives the difference between the first average wheel signal, which is a reference signal for a state of no or a known wear of the rail, and the second average wheel signal, that relates to wheel signals that are detected after the detection of the first set of wheel signals. Therefore, the second average wheel signal relates to a state of increased wear of the rail in comparison to the first average wheel signal. The greater the difference signal is, the greater is the wear of the rail. This means, advantageously the state of wear of a rail can be determined from wheel signals of a wheel sensor. No further equipment is required at the rail.

According to at least one embodiment of the method a plurality of difference signals is determined for the differences between a plurality of second average wheel signals and the first average wheel signal. For each second set of wheel signals a second average wheel signal is determined. For each second average wheel signal a difference signal given by the difference between the respective second average wheel signal and the first average wheel signal is determined. This means, for each second set of wheel signals the state of wear of the rail can be determined. Thus, the state of the rail can be monitored continuously.

According to at least one embodiment of the method an output signal is provided if the difference signal is larger than a predetermined threshold value. The threshold value can be an indicator that the wear of the rail is that large that the wheel sensor should be lowered in order to avoid the damage of the wheel sensor by passing wheels. This means, if the difference signal is larger than the threshold value the distance between wheels of passing rail vehicles and the wheel sensor is decreased in comparison to an initial mounting of the wheel sensor. The threshold value can be predetermined in such a way that the output signal indicates that the wheel sensor should be lowered in order to avoid damage. Therefore, the output signal is advantageously an indicator for a state of wear of the rail that is critical for the wheel sensor.

The threshold value can be determined via extrapolation between two points of measurement at the rail. For this purpose, the distance between the wheel sensor and a wheel on the rail is determined at two different points in time. Furthermore, for these two different points in time the difference between the second average wheel signals is determined. This means, the value of the difference signal can be correlated with a change in the distance between the wheel sensor and the wheel. The decrease of the distance between the wheel sensor and the wheel is then extrapolated into the future.

Another possibility to determine the threshold value is to estimate the wear of the rail over time based on previous measurements on rails and based on previous time intervals in which rails have to be replaced.

According to at least one embodiment of the method the first average wheel signal comprises the average value of the maximum amplitude of the wheel signals of the first set of wheel signals. Each wheel signal comprises a maximum amplitude value. The maximum amplitude value depends on the distance between the wheel sensor and the passing wheel. Therefore, the maximum amplitude value depends on the wear of the rail. By determining the first average wheel signal the average of the maximum amplitude values of the wheel signals of the first set of wheel signals is determined. In this way, the first average wheel signal can be related to a state of negligible wear of the rail and to the distance between the wheel sensor and a wheel in this state.

According to at least one embodiment of the method the second average wheel signal comprises the average value of the maximum amplitude of the wheel signals of the second set of wheel signals. Each wheel signal comprises a maximum amplitude value. The maximum amplitude value depends on the distance between the wheel sensor and the passing wheel. Therefore, the maximum amplitude value depends on the wear of the rail. By determining the second average wheel signal the average of the maximum amplitude values of the wheel signals of the second set of wheel signals is determined. In this way, the second average wheel signal can be related to a state of increased wear in comparison to the time when the first set of signals is detected. The second average wheel signal can further be related to a reduced distance between the wheel sensor and a wheel in comparison to the state of no wear of the rail.

According to at least one embodiment of the method intermediate second average wheel signals of subsets of the second set of wheel signals are determined by the wheel sensor and the second average wheel signal is determined from the intermediate second average wheel signals by an evaluation unit. The second set of wheel signals comprises at least two subsets of wheel signals. The subsets each comprise at least two wheel signals. For example, each subset comprises eight wheel signals. The second set of wheel signals can comprise eight subsets of wheel signals. For each subset of wheel signals an intermediate second average wheel signal is determined by the wheel sensor. An intermediate second average wheel signal is determined by averaging all wheel signals of a subset of wheel signals. This means, the mean value of the wheel signals of one subset of wheel signals is determined. An intermediate second average wheel signal can be determined by adding up the wheel signals of a subset of wheel signals and by dividing this value by the number of wheel signals of the subset of wheel signals. The second average wheel signal is determined by averaging all intermediate second average wheel signals. This means, the mean value of the intermediate second average wheel signals is determined for determining the second average wheel signal.

As the intermediate second average wheel signals are determined by the wheel sensor it is only required to submit the intermediate second average wheel signals to the evaluation unit for further evaluation but not all wheel signals of the subsets of wheel signals. Therefore, the amount of data to be transferred is reduced.

According to at least one embodiment of the method the second set of wheel signals is provided to an evaluation unit, where the second average wheel signal is determined. This means, all wheel signals of the second set of wheel signals are provided to the evaluation unit. No averaging takes place in the wheel sensor. Therefore, a unit for determining average wheel signals is not required in the wheel sensor.

Furthermore, an evaluation system for measuring wear of a rail is provided. The evaluation system can preferably be employed in the methods described herein. This means all features disclosed for the method for measuring wear of a rail are also disclosed for the evaluation system and vice-versa.

In at least one embodiment of the evaluation system for measuring wear of a rail, the evaluation system comprises an input for receiving signals from at least one wheel sensor mounted to the rail. The input can be configured to receive wheel signals detected by the wheel sensor. It is further possible that the input is configured to receive intermediate second average wheel signals and/or second average wheel signals. The input can further be configured to receive the first average wheel signal. The evaluation system can be connected to the at least one wheel sensor.

The evaluation system further comprises a memory unit, where a first average wheel signal of a first set of wheel signals is saved. After the first average wheel signal is determined it is saved in the memory unit.

The evaluation system further comprises an averaging unit that is configured to determine a second average wheel signal of a second set of wheel signals. The averaging unit is connected to the input. The second average wheel signal of the second set of wheel signals is determined by averaging all wheel signals of the second set of wheel signals. This means, the mean value of the wheel signals of the second set of wheel signals is determined. The wheel signals of the second set of wheel signals are provided to the averaging unit via the input. The averaging unit can comprise a central processing unit. The central processing unit can be configured to determine the second average wheel signal.

The evaluation system further comprises a comparator unit that is configured to determine a difference signal given by the difference between the second average wheel signal and the first average wheel signal. The comparator unit is connected to the memory unit and to the averaging unit. The comparator unit is configured to receive the first average wheel signal from the memory unit. The comparator unit is further configured to receive the second average wheel signal from the averaging unit. The comparator unit can comprise a central processing unit for determining the difference signal.

Each wheel signal relates to a wheel of a rail vehicle passing the wheel sensor. This means, each time a wheel of a rail vehicle passes the wheel sensor, a wheel signal is detected.

By employing the evaluation system the state of wear of a rail can be determined. The state of wear of a rail is determined from wheel signals detected by at least one wheel sensor. Therefore, advantageously no other equipment or instruments are required for determining the wear of the rail. This means, the wear of a rail can be measured with an improved efficiency by the evaluation system.

In at least one embodiment of the evaluation system, the evaluation system further comprises an output for providing an output signal if the difference signal is larger than a predetermined threshold value. For this purpose, the evaluation system comprises a further comparator unit. The further comparator unit is configured to compare the difference signal to the predetermined threshold value. The predetermined threshold value is saved in the memory unit. The further comparator unit is connected to the comparator unit and to the memory unit. The threshold value can be an indicator that the wear of the rail is that large that the wheel sensor should be lowered in order to avoid the damage of the wheel sensor by passing wheels. The threshold value can be predetermined in such a way that the output signal indicates that the wheel sensor should be lowered in order to avoid damage. Therefore, the output signal is advantageously an indicator for a state of wear of the rail that is critical for the wheel sensor.

In at least one embodiment of the evaluation system, the averaging unit comprises an evaluation unit that is configured to determine the second average wheel signal. The evaluation unit can be a central unit that is not located in the vicinity of the wheel sensors. The evaluation unit can be configured to receive the second set of wheel signals for determining the second average wheel signal. In this case, no evaluation of the wheel signals needs to be carried out by the wheel sensor. Therefore, the setup of the wheel sensor can be simple and robust.

In at least one embodiment of the evaluation system, the averaging unit comprises the wheel sensor and an evaluation unit, wherein the wheel sensor comprises a further averaging unit that is configured to determine intermediate second average wheel signals of subsets of the second set of wheel signals, and wherein the wheel sensor is connected to the evaluation unit. The averaging unit can comprise a plurality of wheel sensors mounted at different positions along the rail. The further averaging unit can comprise a microprocessor which is configured to determine the intermediate second average wheel signals. The wheel sensor can comprise an output that is configured to provide the intermediate second average wheel signals. The evaluation unit can comprise an input where the intermediate second average wheel signals can be received. The evaluation unit can be a central unit that is not arranged in the vicinity of the wheel sensors. As the intermediate second average wheel signals are determined by the wheel sensor it is only required to submit the intermediate second average wheel signals to the evaluation unit for further evaluation but not all wheel signals of the subsets of wheel signals. Therefore, the amount of data to be transferred is reduced.

The following description of figures may further illustrate and explain exemplary embodiments. Components that are functionally identical or have an identical effect are denoted by identical references. Identical or effectively identical components might be described only with respect to the figures where they occur first. Their description is not necessarily repeated in successive figures.

Figure 2:
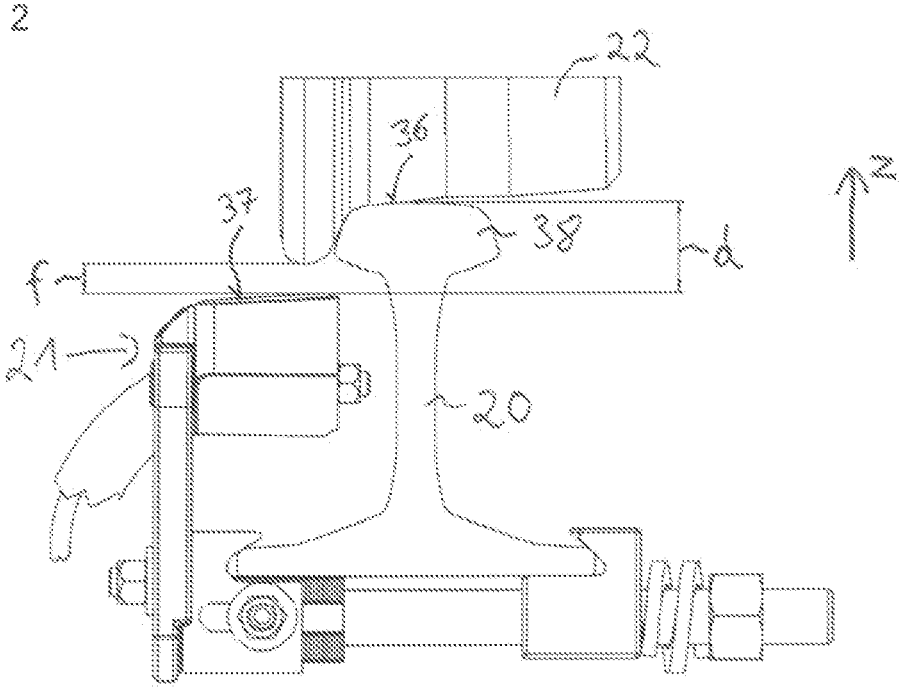

FIGS. 1 and 2 show side views of an exemplary embodiment of a wheel sensor mounted to a rail.

Figure 3:
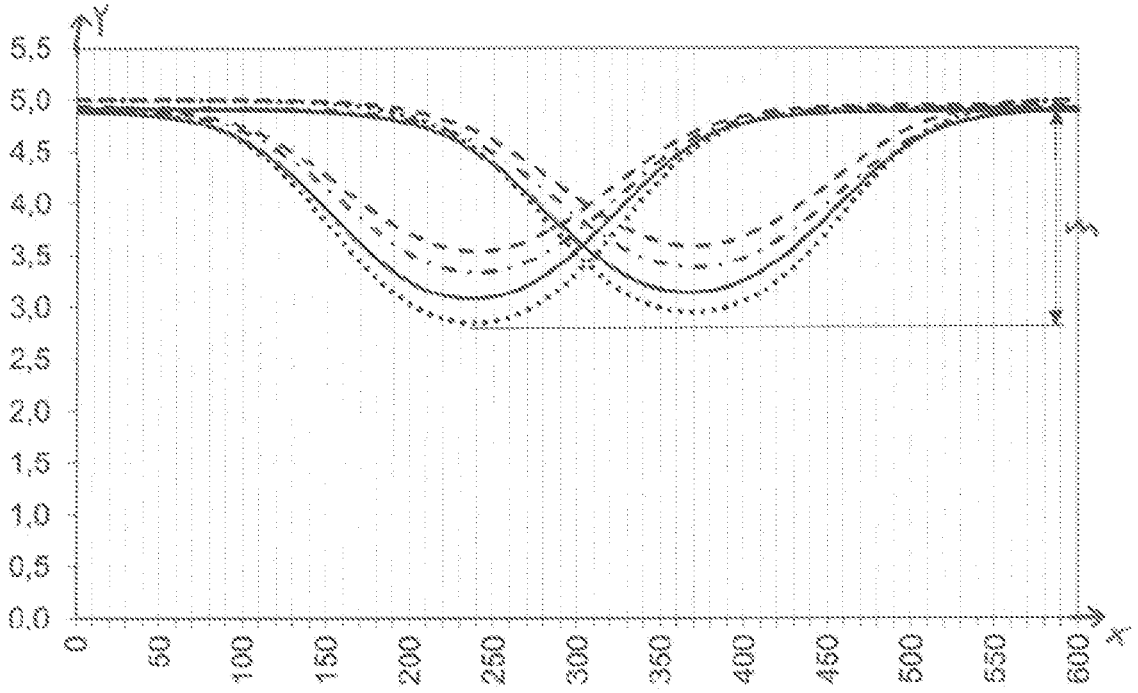

In FIG. 3 exemplary wheel signals are plotted.

Figure 4:
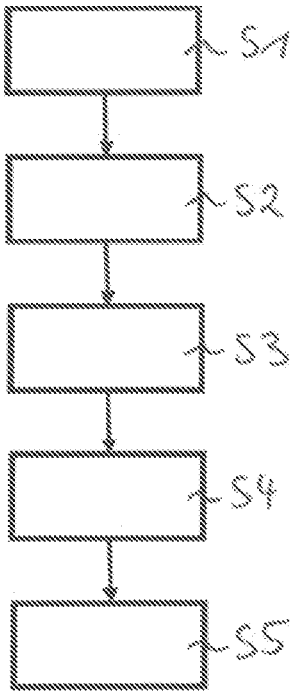
Figure 5:
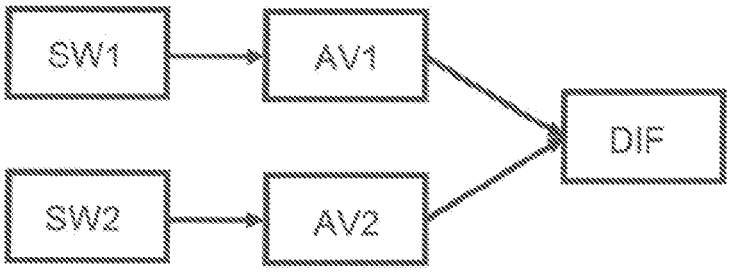
Figure 6:
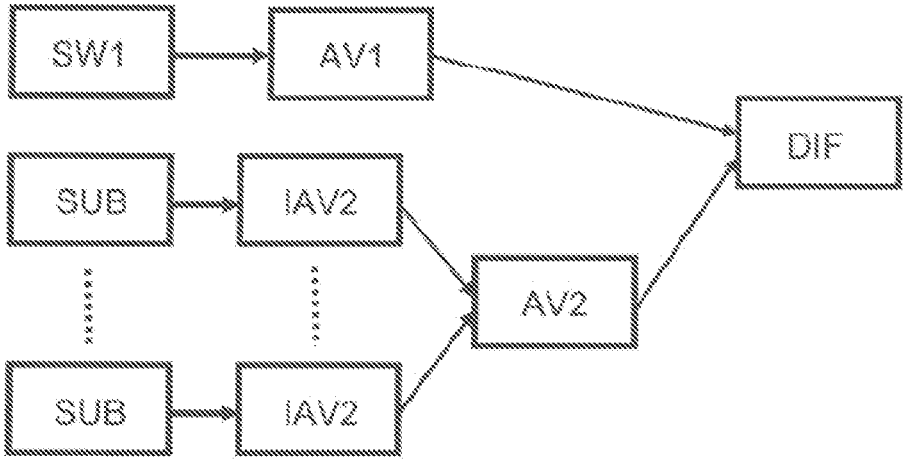

FIGS. 4, 5 and 6 schematically show exemplary embodiments of the method for measuring wear of a rail.

FIGS. 7, 8, 9 and 10 show exemplary embodiments of the evaluation system for measuring wear of a rail.

In FIG. 1 a side view of an exemplary embodiment of a wheel sensor 21 is shown. The wheel sensor 21 is mounted to a rail 20. The wheel sensor 21 is mounted to the rail 20 via a mounting system 31. The mounting system 31 comprises a carrier 32 on which the wheel sensor 21 is mounted. The carrier 32 is connected to a clamp 33 which extends below the rail 20. The clamp 33 is fixed to the rail 20 at a bottom side 34 of the rail 20, where the bottom side 34 faces away from the side where wheels 22 of passing rail vehicles can be positioned. The wheel sensor 21 is supplied with energy via a cable 35 connected to the wheel sensor 21.

In FIG. 1 a cross section through the rail 20 is shown. On a top surface 36 of the rail 20 a wheel 22 of a rail vehicle is positioned. FIG. 1 only shows a part of the wheel 22. The top surface 36 of the rail 20 faces away from the bottom side 34. The top surface 36 of the rail 20 is arranged at a top part 38 of the rail 20.

In the situation of FIG. 1 the rail 20 is relatively new. Therefore, wear of the rail 20 can be neglected. At this initial stage the top surface 36 is spaced from a top side 37 of the wheel sensor 21 by a distance d. The top side 37 of the wheel sensor 21 is spaced from the wheel flange of the wheel 22 by a distance f. The wheel sensor 21 is mounted to the rail 20 in such a way that wheels 22 of passing rail vehicles do not touch the wheel sensor 21.

FIG. 2 shows another side view of the exemplary embodiment of the wheel sensor 21. In comparison to the situation shown in FIG. 1, in this case the rail 20 has been used for a while so that the rail 20 shows wear. This means, the height of the top part 38 of the rail 20 is reduced. By a large number of rail vehicles passing the rail 20 a part of the top part 38 is removed so that the thickness of the top part 38 is reduced. This means, the wear of the rail 20 takes place in a vertical direction z. Therefore, also the distance d between the top surface 36 of the rail 20 and the top side 37 of the wheel sensor 21 is reduced in comparison to the situation shown in FIG. 1. The distance f between the wheel flange and the top side 37 of the wheel sensor 21 is reduced as well. In order to avoid a damage of the wheel sensor 21 by wheels 22 of passing rail vehicles it is necessary to lower the position of the wheel sensor 21 with respect to the top surface 36 of the rail 20.

In FIG. 3 examples of wheel signals are plotted. On the x-axis the distance is plotted in mm. On the y-axis the current is plotted in mA. The wheel sensor 21 comprises two sensors which each are inductive sensors. The change in the current plotted on the y-axis indicates the movement of electrically conductive material in the vicinity of the wheel sensor 21. In this way, the presence of a wheel 22 of a rail vehicle can be detected. Each of the sensors detects one wheel signal per wheel 22. Each wheel signal comprises a plurality of amplitude values that are plotted on the y-axis in FIG. 3. Moreover, each wheel signal has a maximum amplitude value. The maximum amplitude value is the value which differs the most from the value for the situation that no wheel 22 is present close to the wheel sensor 21. In other words, the maximum amplitude value is the value of the wheel signal that differs the most from an initial value. For the first one of the two sensors the wheel signal drops at around 250 mm. The drop of the wheel signal relates to a wheel 22 passing the wheel sensor 21. The maximum amplitude value is in this case the lowest value on the y-axis of each wheel signal, respectively. For the second one of the two sensors the wheel signal drops at around 350 mm. As the first sensor is mounted spaced apart from the second sensor, the wheel signals of the two different sensors drop at different distances.

In FIG. 3 for each of the two sensors wheel signals are plotted for different points in time. The dashed lines relate to a state where the rail 20 is relatively new and wear of the rail 20 is negligible. The other three wheel signals are detected after this first wheel signal. The dashed-dotted lines relate to a state of increased wear of the rail 20 in comparison to the state of the dashed line. The dotted lines relate to a state of maximum wear of the rail 20. The maximum amplitude of the wheel signals is different for the different states of wear of the rail 20. This means, the maximum amplitude of the wheel signals can be related to the state of wear of the rail 20. In FIG. 3, as an example the maximum amplitude m is shown for the dotted line, this means for the state of maximum wear of the rail 20.

FIG. 4 schematically shows an exemplary embodiment of the method for measuring wear of a rail 20. A first step S1 of the method comprises detecting a first set of wheel signals SW1 by a wheel sensor 21 mounted to the rail 20. In each case, a wheel signal is detected when a wheel 22 of a rail vehicle passes the wheel sensor 21. In a second step S2 of the method a first average wheel signal AV1 of the first set of wheel signals SW1 is determined. The first average wheel signal AV1 comprises the average value of the maximum amplitude of the wheel signals of the first set of wheel signals SW1. The first average wheel signal AV1 is a reference signal for a state of no or a known wear of the rail 20. A third step S3 of the method comprises detecting at least one second set of wheel signals SW2 by the wheel sensor 21, where the second set of wheel signals SW2 is detected after detecting the first set of wheel signals SW1. The first set of wheel signals SW1 and the second set of wheel signals SW2 can comprise the same number of wheel signals. For example, the first set of wheel signals SW1 and the second set of wheel signals SW2 comprise at least 10 wheel signals, respectively. In a fourth step S4 of the method a second average wheel signal AV2 of the second set of wheel signals SW2 is determined. The second average wheel signal AV2 comprises the average value of the maximum amplitude of the wheel signals of the second set of wheel signals SW2. The second average wheel signal AV2 can be determined by an evaluation unit 29 to which the second set of wheel signals SW2 is provided. A fifth step S5 of the method comprises determining a difference signal DIF given by the difference between the second average wheel signal AV2 and the first average wheel signal AV1. The difference signal DIF relates to the state of wear of the rail 20. It is further possible that a plurality of difference signals DIF is determined for the differences between a plurality of second average wheel signals AV2 and the first average wheel signal AV1. In the fifth step S5 an output signal is provided if the difference signal DIF is larger than a predetermined threshold value.

Instead of providing the second set of wheel signals SW2 to the evaluation unit 29 and determining the second average wheel signal AV2 by the evaluation unit, subsets SUB of the second set of wheel signals SW2 can be detected. This means, the wheel sensor 21 can be configured to detect subsets SUB of the second set of wheel signals SW2. Each subset SUB comprises at least two wheel signals. The second set of wheel signals SW2 can comprise several subsets SUB of wheel signals. The wheel sensor 21 can be configured to determine intermediate second average wheel signals IAV2 of the subsets SUB of the second set of wheel signals SW2. This means, the wheel sensor 21 is configured to determine an intermediate second average wheel signal IAV2 for each subset SUB. Subsequently, the second average wheel signal AV2 is determined from the intermediate second average wheel signals IAV2 by the evaluation unit 29.

FIG. 5 schematically shows an exemplary embodiment of the method for measuring wear of a rail 20. The first set of wheel signals SW1 is detected by the wheel sensor 21 and the first average wheel signal AV1 of the first set of wheel signals SW1 is determined. Subsequently, at least one second set of wheel signals SW2 is detected by the wheel sensor 21 and the second average wheel signal AV2 of the second set of wheel signals SW2 is determined. In a next step, the difference signal DIF given by the difference between the second average wheel signal AV2 and the first average wheel signal AV1 is determined.

FIG. 6 schematically shows another exemplary embodiment of the method for measuring wear of a rail 20. In comparison to the embodiment shown in FIG. 5 the second average wheel signal AV2 is determined differently. Subsets SUB of the second set of wheel signals SW2 are detected by the wheel sensor 21. For each subset SUB an intermediate second average wheel signal IAV2 is determined by the wheel sensor 21. Subsequently, the second average wheel signal AV2 is determined from the intermediate second average wheel signals IAV2 by the evaluation unit 29. In a next step, the difference signal DIF given by the difference between the second average wheel signal AV2 and the first average wheel signal AV1 is determined.

Figure 7:
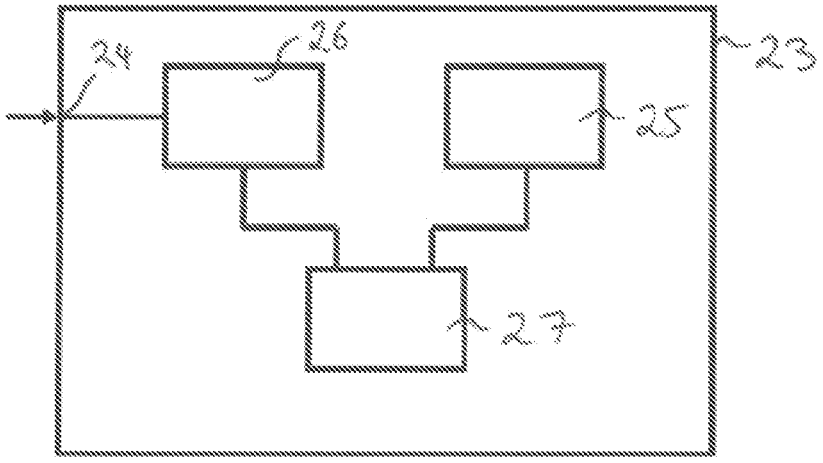

FIG. 7 shows an exemplary embodiment of an evaluation system 23 for measuring wear of a rail 20. The evaluation system 23 comprises an input 24 for receiving signals from at least one wheel sensor 21 mounted to the rail 20. The signals can be wheel signals. Each wheel signal relates to a wheel 22 of a rail vehicle passing the wheel sensor 21. The evaluation system 23 further comprises a memory unit 25, where a first average wheel signal AV1 of a first set of wheel signals SW1 is saved. The evaluation system 23 further comprises an averaging unit 26 that is configured to determine a second average wheel signal AV2 of a second set of wheel signals SW2. The averaging unit 26 is connected to the input 24. The evaluation system 23 further comprises a comparator unit 27 that is configured to determine a difference signal DIF given by the difference between the second average wheel signal AV2 and the first average wheel signal AV1. The comparator unit 27 is connected to the memory unit 25 and the averaging unit 26.

Figure 8:
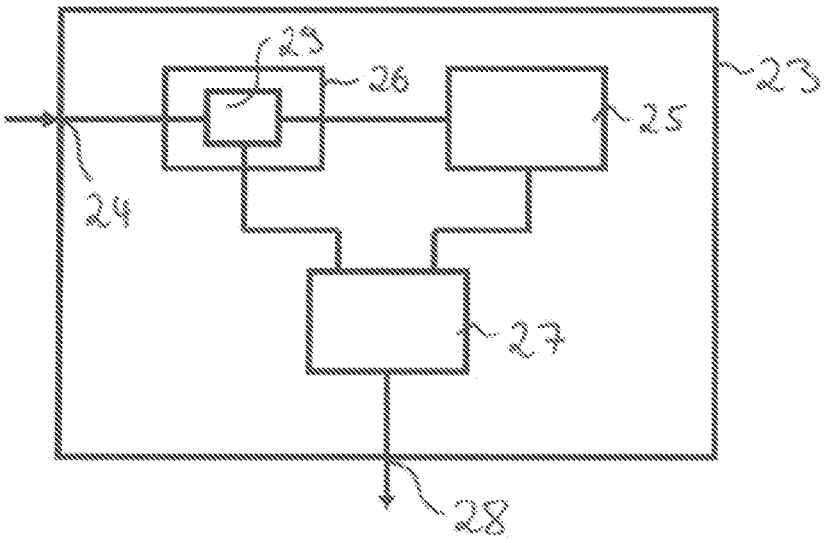

FIG. 8 shows another exemplary embodiment of the evaluation system 23. In comparison to the embodiment shown in FIG. 7 the averaging unit 26 comprises an evaluation unit 29 that is configured to determine the second average wheel signal AV2. The evaluation unit 29 is connected to the input 24, to the memory unit 25 and to the comparator unit 27. Furthermore, the evaluation system 23 comprises an output 28 for providing an output signal if the difference signal DIF is larger than a predetermined threshold value.

Figure 9:
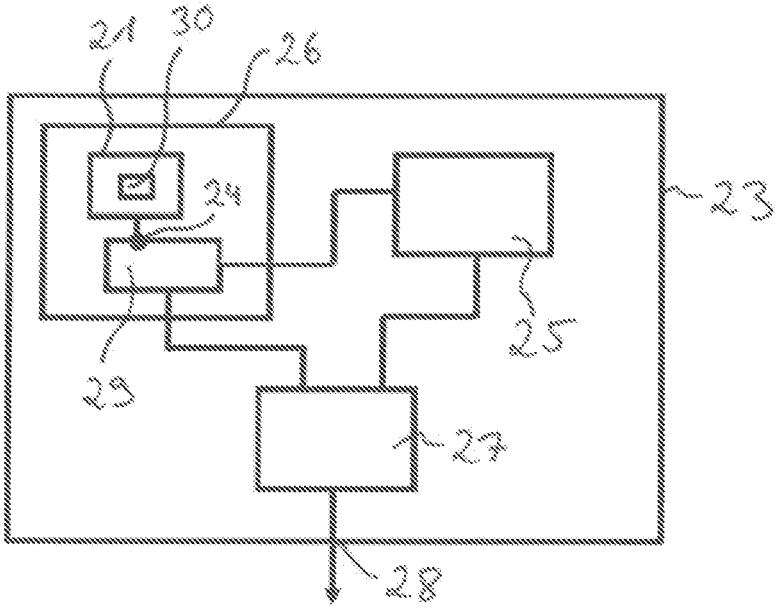

FIG. 9 shows another exemplary embodiment of the evaluation system 23. In comparison to the embodiment shown in FIG. 7 the averaging unit 26 comprises the wheel sensor 21 and an evaluation unit 29. The wheel sensor 21 can be arranged spaced apart from the other components of the evaluation system 23. The wheel sensor 21 is arranged in the vicinity of the rail 20. The wheel sensor 21 can be mounted to the rail 20. The evaluation unit 29 comprises the input 24 of the evaluation system 23 and is connected with the wheel sensor 21 via the input 24. The evaluation unit 29 is further connected to the memory unit 25 and to the comparator unit 27. Furthermore, the evaluation system 23 comprises an output 28 for providing an output signal if the difference signal DIF is larger than a predetermined threshold value.

The wheel sensor 21 comprises a further averaging unit 30 that is configured to determine intermediate second average wheel signals IAV2 of subsets SUB of the second set of wheel signals SW2. The intermediate second average wheel signals IAV2 are provided to the evaluation unit 29. The evaluation unit 29 is configured to determine the second average wheel signal AV2 from the intermediate second average wheel signals IAV2.

Figure 10:
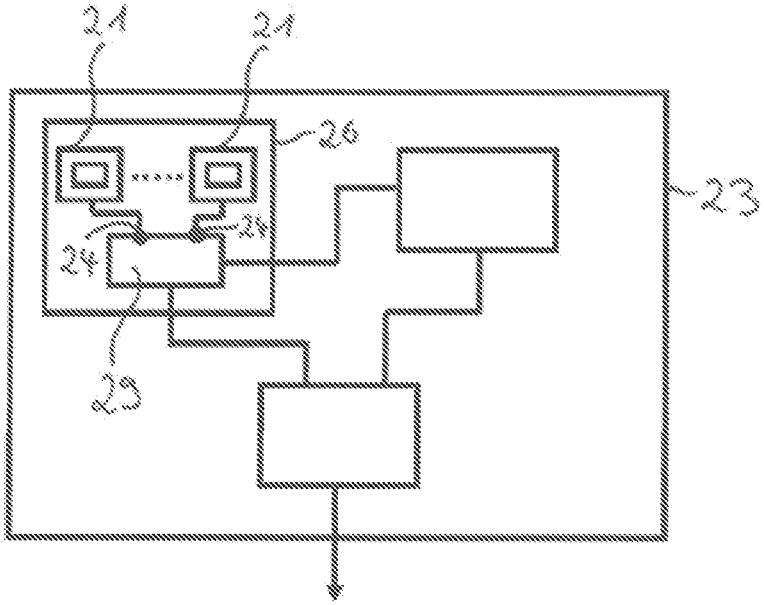

FIG. 10 shows another exemplary embodiment of the evaluation system 23. In comparison to the embodiment shown in FIG. 9 the averaging unit 26 comprises a plurality of wheel sensors 21 which is indicated by the dotted line between the wheel sensors 21. Each wheel sensor 21 is connected with the evaluation unit 29 via an input 24, respectively. Alternatively, which is not shown, all wheel sensors 21 are connected with the evaluation unit 29 via one and the same input 24.

REFERENCE NUMERALS

20: rail
21: wheel sensor
22: wheel
23: evaluation system
24: input
25: memory unit
26: averaging unit
27: comparator unit

28: output
29: evaluation unit
30: further averaging unit
31: mounting system
32: carrier
33: clamp
34: bottom side
35: cable
36: top surface
37: top side
38: top part
AV1: first average wheel signal
AV2: second average wheel signal
DIF: difference signal
d: distance
f: distance
IAV2: intermediate second average wheel signal
m: maximum amplitude
S1-S5: steps
SUB: subset
SW1: first set of wheel signals
SW2: second set of wheel signals
z: vertical direction

The invention claimed is:

1. A method for measuring wear of a rail, the method comprising:

detecting a first set of wheel signals by a wheel sensor;

determining a first average wheel signal of the first set of wheel signals;

detecting at least one second set of wheel signals by the wheel sensor, where the at least one second set of wheel signals is detected after detecting the first set of wheel signals;

determining a second average wheel signal of the at least one second set of wheel signals; and determining a difference signal given by a difference between the second average wheel signal and the first average wheel signal, wherein:

a wheel signal is detected in response to a wheel of a rail vehicle passing the wheel sensor;

the wheel sensor is mounted to the rail;

each wheel signal of the first set of wheel signals comprises a maximum amplitude value;

each wheel signal of the at least one second set of wheel signals comprises a maximum amplitude value; and the difference signal is a measure of wear of the rail.

2. The method according to claim 1, wherein the first set of wheel signals and the at least one second set of wheel signals comprise the same number of wheel signals.

3. The method according to claim 1, wherein the first set of wheel signals and the at least one second set of wheel signals comprise at least ten wheel signals, respectively.

4. The method according to claim 1, wherein the first average wheel signal is a reference signal for a state of no or a known wear of the rail.

5. The method according to claim 1, wherein a plurality of difference signals is determined for differences between a plurality of second average wheel signals and the first average wheel signal.

6. The method according to claim 1, wherein an output signal is provided in response to the difference signal being larger than a predetermined threshold value.

7. The method according to claim 1, wherein the first average wheel signal comprises an average value of the maximum amplitude values of the wheel signals of the first set of wheel signals.

8. The method according to claim 1, wherein the second average wheel signal comprises an average value of the maximum amplitude values of the wheel signals of the at least one second set of wheel signals.

9. The method according to claim 1, wherein intermediate second average wheel signals of subsets of the at least one second set of wheel signals are determined by the wheel sensor, and the second average wheel signal is determined from the intermediate second average wheel signals by an evaluation unit.

10. The method according to claim 1, wherein the at least one second set of wheel signals is provided to an evaluation unit, where the second average wheel signal is determined.

11. An evaluation system for measuring wear of a rail, the evaluation system comprising:

an input for receiving signals from at least one wheel sensor, wherein the at least one wheel sensor is configured to detect a first set of wheel signals, and is configured to detect a second set of wheel signals after detecting the first set of wheel signals;

a memory unit configured to save a first average wheel signal of the first set of wheel signals;

an averaging unit that is configured to determine a second average wheel signal of the second set of wheel signals; and a comparator unit that is configured to determine a difference signal given by a difference between the second average wheel signal and the first average wheel signal, wherein:

each wheel signal of the first set of wheel signals and the second set of wheel signals relates to a wheel of a rail vehicle passing the at least one wheel sensor;

the averaging unit is connected to the input;

the comparator unit is connected to the memory unit and the averaging unit;

the at least one wheel sensor is mounted to the rail;

each wheel signal of the first set of wheel signals comprises a maximum amplitude value;

each wheel signal of the second set of wheel signals comprises a maximum amplitude value; and the difference signal is a measure of wear of the rail.

12. The evaluation system according to claim 11, further comprising an output for providing an output signal in response to the difference signal being larger than a predetermined threshold value.

13. The evaluation system according to claim 11, wherein the averaging unit comprises an evaluation unit that is configured to determine the second average wheel signal.

14. The evaluation system according to claim 11, wherein the averaging unit comprises the at least one wheel sensor and an evaluation unit, wherein the at least one wheel sensor comprises a further averaging unit that is configured to determine intermediate second average wheel signals of subsets of the second set of wheel signals, and wherein the at least one wheel sensor is connected to the evaluation unit.

* * * * *